US007956714B2

(12) United States Patent
Ackermann et al.

(10) Patent No.: US 7,956,714 B2
(45) Date of Patent: Jun. 7, 2011

(54) HIGH VOLTAGE TRANSFORMER

(75) Inventors: Bernd Ackermann, Aachen (DE); Christoph Loef, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 12/097,126

(22) PCT Filed: Dec. 6, 2006

(86) PCT No.: PCT/IB2006/054623

§ 371 (c)(1),
(2), (4) Date: Jun. 12, 2008

(87) PCT Pub. No.: WO2007/069136

PCT Pub. Date: Jun. 21, 2007

(65) Prior Publication Data

US 2008/0297300 A1 Dec. 4, 2008

(30) Foreign Application Priority Data

Dec. 16, 2005 (EP) ..... 05112332

(51) Int. Cl.

| | |
|---|---|
| ***H01F 5/00*** | (2006.01) |
| ***H01F 27/10*** | (2006.01) |
| ***H01F 27/08*** | (2006.01) |
| ***H01F 21/02*** | (2006.01) |
| ***H01F 27/28*** | (2006.01) |
| ***H01F 27/30*** | (2006.01) |
| ***H01F 17/04*** | (2006.01) |

(52) U.S. Cl. ..... 336/200; 336/58; 336/61; 336/145; 336/182; 336/183; 336/198; 336/208; 336/220; 336/221; 336/222; 336/232

(58) Field of Classification Search ..... None
See application file for complete search history.

(56) References Cited

U.S. PATENT DOCUMENTS

| | | | | |
|---|---|---|---|---|
| 5,225,803 | A | 7/1993 | Negle et al. | |
| 5,418,513 | A * | 5/1995 | Fujisawa et al. | 336/178 |
| 5,847,947 | A | 12/1998 | Pan et al. | |
| 6,211,767 | B1 * | 4/2001 | Jitaru | 336/200 |
| 6,278,353 | B1 * | 8/2001 | Downing et al. | 336/200 |
| 6,483,411 | B2 * | 11/2002 | Chiang et al. | 336/182 |
| 6,738,275 | B1 | 5/2004 | Beland | |
| 7,091,817 | B2 * | 8/2006 | Peck et al. | 336/208 |
| 2001/0008552 | A1 * | 7/2001 | Harada et al. | 378/107 |
| 2002/0057178 | A1 * | 5/2002 | Timashov et al. | 336/208 |
| 2002/0089863 | A1 * | 7/2002 | Yasumura | 363/21.14 |
| 2002/0145498 | A1 * | 10/2002 | Yeh et al. | 336/208 |
| 2004/0070475 | A1 * | 4/2004 | Nick et al. | 336/61 |
| 2004/0103952 | A1 * | 6/2004 | Benjey | 141/59 |
| 2004/0113739 | A1 * | 6/2004 | Du et al. | 336/200 |
| 2005/0018815 | A1 | 1/2005 | Loef et al. | |
| 2007/0103952 | A1 * | 5/2007 | Sakai et al. | 363/171 |

FOREIGN PATENT DOCUMENTS

| | | | |
|---|---|---|---|
| EP | 0855851 | A2 | 7/1998 |
| WO | WO0116970 | A1 | 3/2001 |
| WO | WO2005122193 | A1 | 12/2005 |

* cited by examiner

*Primary Examiner* — Anh T Mai
*Assistant Examiner* — Mangtin Lian

(57) ABSTRACT

Primary (4, 8) and secondary (10) windings are subjected to a significant heat stress during operation of a high voltage transformer. The present invention describes a high voltage transformer which is believed to have good temperature properties. This transformer may have a planar primary winding and a Litz secondary winding. The planar primary winding may abut against a planar face of the core (2) therefore allowing for a good heat exchange between these two elements. The Litz secondary winding and the planar primary winding may be cooled by means of a cooling medium.

4 Claims, 2 Drawing Sheets

HIGH VOLTAGE TRANSFORMER

The present invention relates to the field of transformers, in particular for transformers usable in medical applications such as X-ray apparatus or tomography apparatus. In particular, the present invention relates to a high voltage transformer, to a medical apparatus and to the use of a high voltage transformer in a medical apparatus.

High voltage transformers are for example key modules of high voltage generators supplying high power (peak values higher than 100 kW) at high voltages (peak values higher than 100 kV) to X-ray tubes for example for medical diagnostics. There is a trend towards even higher power levels in order to improve picture quality.

It may be an object of the present invention to provide for an improved high voltage transformer.

According to an exemplary embodiment of the present invention, a high voltage transformer is provided comprising a primary winding and a secondary winding. The primary winding is a planar winding and the secondary winding is a Litz winding.

It is believed that the high voltage transformer according to this exemplary embodiment of the present invention allows for an improved cooling of the windings. Also, the high voltage transformer according to this exemplary embodiment of the present invention is believed to be very cost efficient in manufacturing and in maintenance. In a variant of this exemplary embodiment, a flow of a cooling medium such as cooling oil may be provided for example in a horizontal flow direction. Advantageously, this may allow for a very efficient cooling and the cooling medium flows along both the primary winding, the secondary winding, and the core for a relatively long distance.

According to another exemplary embodiment of the present invention, the primary winding comprises a printed circuit board (PCB), which may be a single layer PCB or a multi-layer PCB. Current paths for forming turns of the primary winding are formed on the printed circuit board element if for example the printed circuit board element is a single layer PCB or are formed in/on the printed circuit board element when the PCB is a multi-layer PCB.

According to another exemplary embodiment of the present invention, the high voltage transformer further comprises a bobbin wherein the bobbin has a plurality of slots. These slots are arranged such that the Litz winding is wound in the slots of the bobbin.

It is believed that this arrangement allows for a simple construction and manufacturing of the high voltage transformer.

In a variant of this exemplary embodiment of the present invention, the cooling medium flow is arranged such that the cooling medium flow is essentially parallel to the slots in the bobbin allowing for a very effective cooling of the secondary winding which is the one which is usually subjected to the higher thermal stress of the primary and secondary windings.

According to another exemplary embodiment of the present invention, a core is provided having an opening. This opening may have one or more planar faces arranged such that one or more planar winding elements abut to this at least one planar face. Due to this, a surface of the planar winding element abuts against a planar face of the core which may allow for a good thermal conductivity from the planar winding to the core.

According to another exemplary embodiment of the present invention, there may be provided two planar windings which are respectively arranged at two respective planar faces in an opening of the core opposite to each other. Between the two planar windings, there may be arranged the bobbin.

It is believed that this exemplary embodiment of the present invention may allow for a cost efficient reliable high voltage transformer. In particular, in a variant of this exemplary embodiment of the present invention, a cooling medium flow may be provided in the opening of the high voltage transformer for example in a direction parallel to the slots in the bobbin on which the turns of the secondary winding are wound. Due to the fact that the cooling medium streams along the direction of the turns of the secondary winding, a good cooling of the secondary winding may be provided. Furthermore, due to the fact that parts of the surfaces of the planar windings directly abut to planar faces of the core, a good thermal conductivity from the planar primary winding to the core may be provided. The cooling medium streaming along parts of its surfaces further enhances cooling of the planar primary winding. Due to this, a reliable transformer may be provided since thermal stress may be kept relatively low.

It may be seen as the gist of an exemplary embodiment of the present invention that a high voltage transformer has been provided comprising a planar primary winding and a Litz secondary winding which may allow for a cost efficient and thermal stable high voltage transformer which may be advantageous in particular in medical applications such as X-ray apparatus or a tomography apparatus.

BRIEF DESCRIPTION OF THE DRAWINGS

Exemplary embodiments of the present invention will be described in the following with reference to the following drawings.

DETAILED DESCRIPTION OF EXEMPLARY EMBODIMENTS

Figure 1:
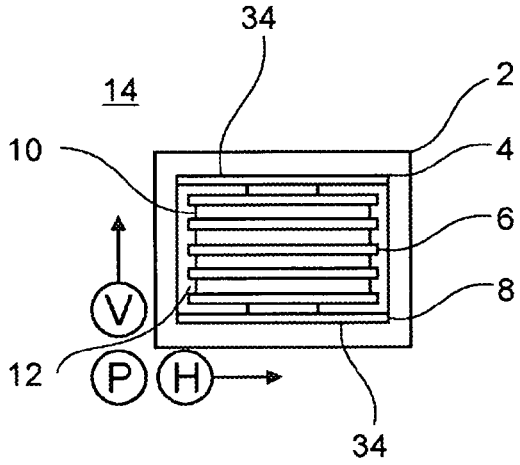
FIG. 1 shows a front view of an exemplary embodiment of a high voltage transformer of the present invention.

In the following description of FIGS. 1 to 6, the same reference numerals are used to designate the same or corresponding elements.

FIG. 1 shows a front view of a high voltage transformer 14 according to an exemplary embodiment of the present invention. The high voltage transformer comprises a core 2 which is in the representation of FIG. 1 a rectangular core such as an E core or similar which may for example be made of sheet metal or sintered ferrite. The core 2 has an opening 12 for accommodating the windings. The opening 12 in the exemplary embodiment of FIG. 1 is essentially rectangular and has four faces two of which are respectively parallel to each other. The inner faces of the opening 12 are planar faces. In the middle of the opening 12, the centre leg of the core 2 may be provided.

Reference numeral 4 in FIG. 1 designates a first planar winding and reference numeral 8 designates a second planar winding. As may be taken from FIG. 1, the planar windings 4 and 8 are arranged on parallel sides of the opening 12 and are also arranged essentially parallel to each other. The planar primary windings 4 and 8 are also arranged in the opening 12 such that planar surfaces thereof respectively abut against the planar faces of the opening 12. This may allow for a good heat exchange between the primary windings 4 and 8 and the core 2. The planar faces in the opening 12 which are adapted for abutment of the surfaces of the planar primary windings 4 and 8 are designated with reference numeral 34. Between the primary windings 4 and 8 there is arranged a bobbin 6 comprising a plurality of parallel slots which are arranged in FIG. 1 in the horizontal direction. In these slots, there are Litz lines. In other words, a plurality of turns of Litz wire is wound on each of the slots in the bobbin 6 for forming the secondary winding 10. The secondary winding 10 which is formed by turns of Litz lines or wires is referred to as Litz winding. Thus, the high voltage transformer depicted in FIG. 1 is a high voltage transformer having a primary winding which is a planar winding and a secondary winding which is a Litz winding.

Figure 2:
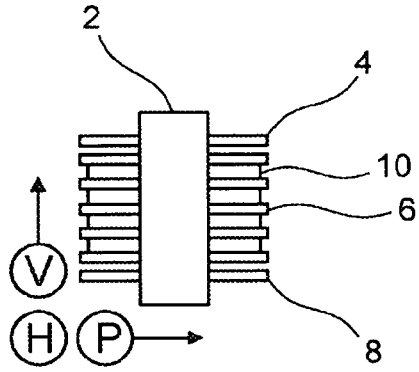
FIG. 2 shows a side view of the transformer of FIG. 1.
Figure 3:
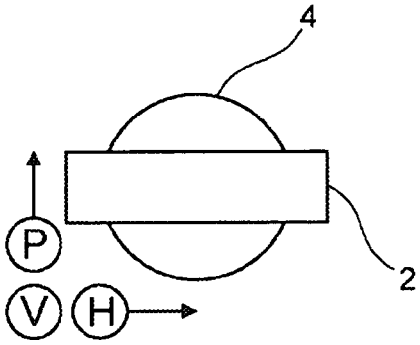
FIG. 3 shows a top view of the transformer of FIG. 1.

As may be taken from FIG. 1, a good cooling of the secondary winding may be achieved by generating a horizontal flow of cooling medium such as transformer oil in the opening 12 of the transformer. The horizontal direction is indicated in FIGS. 1 to 3 with the encircled H. The perpendicular direction is indicated with the encircled P and the vertical direction is indicated with the encircled V. Also, a flow of cooling medium in the perpendicular direction may allow for a good cooling of the secondary winding. Thus, it may be stated that in the transformer of FIG. 1, a good cooling of the secondary winding 10 may be achieved with a flow of cooling medium in the perpendicular and/or in the horizontal direction. Furthermore, this flow of the cooling medium will also result in a good cooling of parts of the surface of the planar primary winding. Also, it may be stated that the primary windings 4 and 8 may have a good heat exchange to the core due to the large surface which respectively abuts against a planar face of the core allowing for a good heat exchange.

FIG. 2 shows a side view of the transformer of FIG. 1. As may be taken from FIG. 2, the secondary winding 10 is sandwiched between the two (or more) primary windings 4 and 8. The turns of the secondary winding 10 on the bobbin 6 extend along the perpendicular and along the horizontal direction such that a flow of cooling medium along one of these two directions may allow a good cooling of the Litz wires in the slots of the bobbin. The relatively flat planar primary winding 4, 8 extend along the perpendicular and along the horizontal direction such that a flow of cooling medium along one of these two directions may allow a good cooling of parts of their surface.

FIG. 3 shows a top view of the transformer of FIG. 3.

As may be taken from FIG. 3, the primary windings 4, 8 and the secondary winding 10 may be circular or cylindrical.

Figure 4:
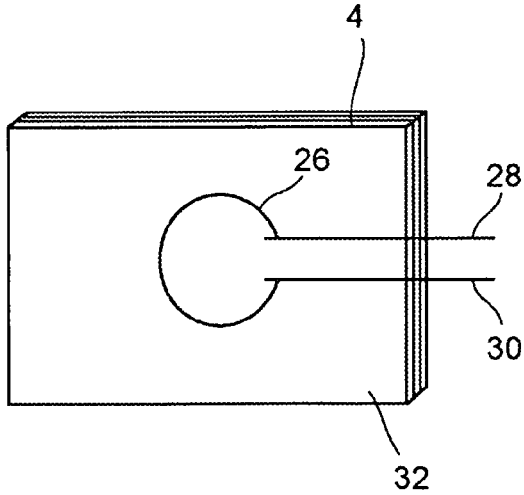
FIG. 4 shows a simplified schematic representation of a planar winding according to an exemplary embodiment of the present invention.

FIG. 4 shows a simplified representation of a planar winding according to an exemplary embodiment of the present invention as it may be used as primary winding 4 or 8 for the transformer of an exemplary embodiment of the present invention. The planar winding which is also referred to with reference numeral 4 may, as indicated in FIG. 4, comprise a plurality of layers. For the sake of simplicity, the windings which may be formed by copper layers on the respective surfaces of the respective layers are only shown on the top layer of the planar layer 4. However, respective turns or windings may be provided on each layer of the multi-layer PCB (Printed Circuit Board). The current may be provided to the turns by means of terminals 28 and 30. As may be taken from FIG. 4 a plurality of turns 26 may be provided on the surface. The surface of this planar primary winding which may be made from a PCB is designated with reference numeral 32. If such a planar winding is arranged such that the surface 32 of the planar winding abuts against a surface 34 of the inner opening 12 of the transformer, a good heat exchange between the primary winding and the core may be provided.

Figure 5:
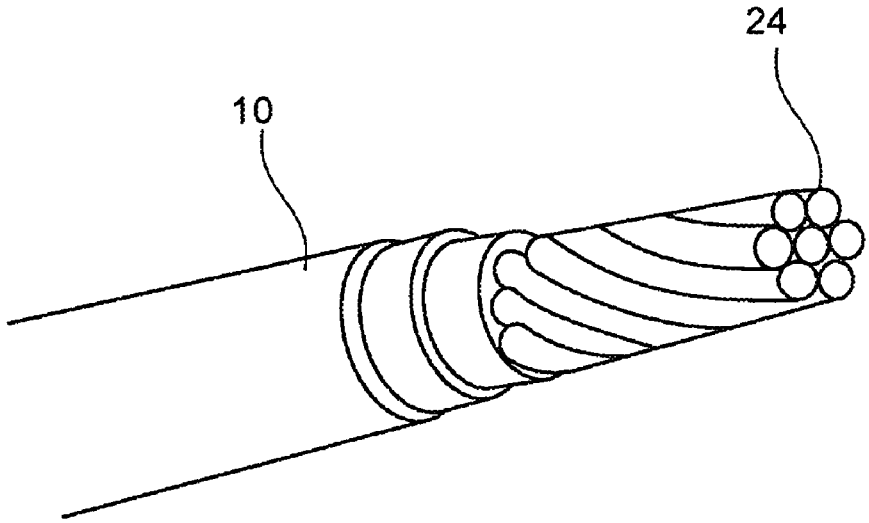
FIG. 5 shows a portion of a Litz winding according to an exemplary embodiment of the present invention.

FIG. 5 shows a portion of a Litz wire 10 as it may be used for the secondary winding. As may be taken from FIG. 5 a plurality of individual wires 24 may be wound for forming the Litz wire 10 depicted in FIG. 5. Also, the Litz wire 10 may be provided with an isolation on the outer side thereof to avoid short circuits to neighbouring wires of the secondary winding.

Figure 6:
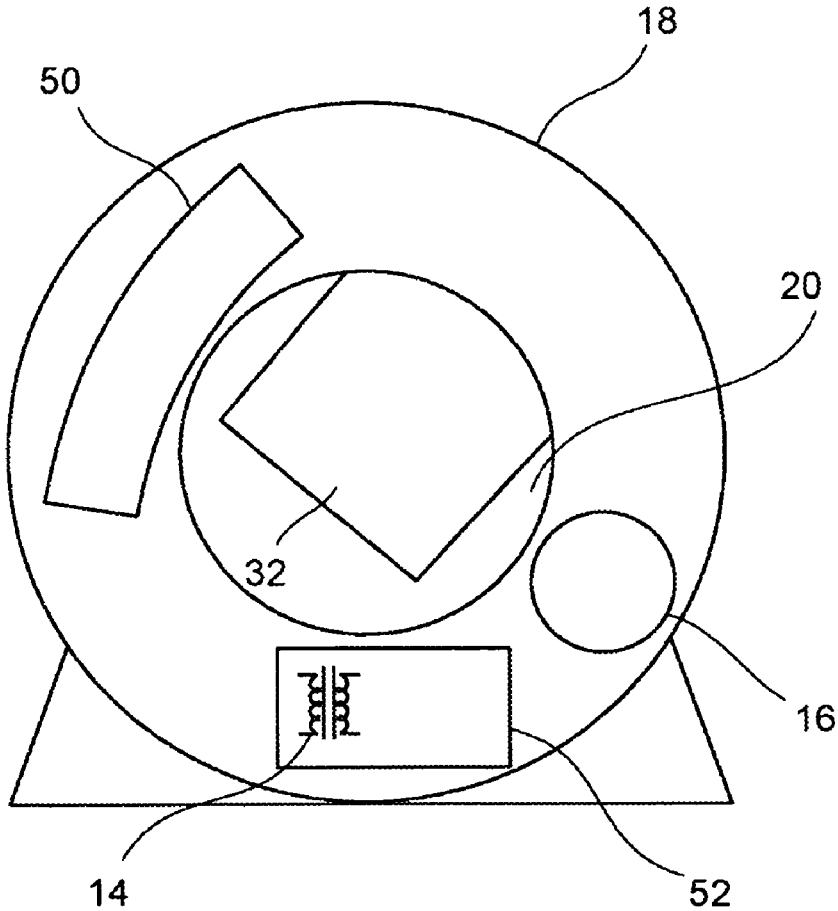
FIG. 6 shows a simplified schematic representation of a medical apparatus according to an exemplary embodiment of the present invention with a high voltage transformer according to an exemplary embodiment of the present invention.

FIG. 6 shows a simplified schematic representation of an exemplary embodiment of a medical apparatus according to the present invention. As may be taken from FIG. 6, the medical apparatus comprises a high voltage transformer 14 according to an exemplary embodiment of the present invention for example the one depicted in FIG. 1. Furthermore, there is provided an X-ray source 16 and an X-ray detector 50. Reference numeral 52 designates a high voltage tank including the transformer 14. The transformer 14, the high voltage tank 52, the X-ray detector 50 and the X-ray source 16 may be mounted on a rotatable gantry 18 such that the transformer 14 and the X-ray source 16 may rotate around the object's bed 32 extending through an opening 20 in the gantry 18. The apparatus depicted in FIG. 6 may be a computer tomography apparatus.

It is believed that the transformer according to an exemplary embodiment of the present invention, due to its good cooling properties may be provided with lesser cooling medium or lesser means for conducting heat away from the windings. Due to this, it is believed that a weight of the transformer may be reduced. Furthermore, this may allow to reduce a size of such high voltage transformers and generators. Thus, in particular in computer tomographs, this will enable an increase of the rotational speed of the gantry heating while resulting also in an improved image quality. Overall, it is believed that the high voltage transformer according to the present invention may allow for increasing a power density of high voltage transformers.

In spite of the fact that the high voltage transformer according to this exemplary embodiment of the present invention was primarily described with reference to medical applications such as X-ray apparatus or a computer tomography apparatus, it should be noted that the transformer according to this exemplary embodiment of the present invention may be applied in other high voltage transformation applications or generators. For example, such a transformer may be applied in a welding apparatus.

It should be noted that "comprising" does not exclude other elements or steps and that "a" or "an" does not exclude a plurality. Furthermore, it should be noted that any reference signs in the claims shall not be construed as limiting the scope of the claims.

The invention claimed is:

1. A high voltage transformer, comprising:

a core comprising a plurality of planar faces that define an opening in the core;

a cooling medium flow in the opening of the core;

a primary winding comprising one or more planar primary windings arranged in the opening such that a surface of each planar primary winding abuts against a planar face of the core;

a bobbin comprising a plurality of parallel slots, wherein the bobbin is arranged between planar primary windings, and wherein the bobbin is arranged in the opening such that cooling medium flow is parallel to the slots in the bobbin;

a secondary winding comprising a Litz winding, wherein the Litz winding is wound in the slots of the bobbin; and wherein the cooling medium flow streams along parts of the surfaces of the primary and secondary windings.

2. The high voltage transformer of claim 1, wherein the primary winding is a multi-layer printed circuit board.

3. A medical apparatus, comprising:

a high voltage transformer, comprising a core comprising a plurality of planar faces that define an opening in the core;

a cooling medium flow in the opening of the core;

a primary winding comprising one or more planar primary windings arranged in the opening such that a surface of each planar primary winding abuts against a planar face of the core;

a bobbin comprising a plurality of parallel slots, wherein the bobbin is arranged between planar primary windings, and wherein the bobbin is arranged in the opening such that cooling medium flow is parallel to the slots in the bobbin;

a secondary winding comprising a Litz winding, wherein the Litz winding is wound in the slots of the bobbin; and wherein the cooling medium flow streams along parts of the surfaces of the primary and secondary windings.

4. The medical apparatus of claim 3, further comprising: at least one of a gantry and an X-ray source.

* * * * *